United States Patent [19]

Russ et al.

[11] 4,021,931

[45] May 10, 1977

[54] AIR CIRCULATING APPARATUS FOR FLOATING MATERIAL IN WEB FORM

[75] Inventors: Stephen J. Russ, Montreal; Zoltan Beke, LaSalle, both of Canada

[73] Assignee: Midland-Ross Corporation, Cleveland, Ohio

[22] Filed: Nov. 21, 1975

[21] Appl. No.: 634,042

[52] U.S. Cl. ..... 34/156; 34/159; 226/97

[51] Int. Cl.[2] ..... F26B 13/20

[58] Field of Search ..... 34/156, 159, DIG. 13; 226/97; 302/31; 239/542, 553, 590

[56] References Cited

UNITED STATES PATENTS

| | | | |
|---|---|---|---|
| 2,848,820 | 8/1958 | Wallin et al. | 226/97 |
| 3,070,901 | 1/1963 | Allander et al. | 226/97 |
| 3,647,266 | 3/1972 | Hurd et al. | 302/31 |
| 3,736,955 | 6/1973 | Schlesser | 239/542 |
| 3,837,789 | 9/1974 | Schindler et al. | 239/553 |

FOREIGN PATENTS OR APPLICATIONS

| | | | |
|---|---|---|---|
| 1,326,431 | 6/1970 | United Kingdom | 302/31 |

*Primary Examiner*—John J. Camby
*Assistant Examiner*—Larry I. Schwartz
*Attorney, Agent, or Firm*—Woodrow W. Portz

[57] ABSTRACT

Apparatus for treating webs, such as found in pulp dryers, consisting essentially of elongate housings aligned transversely of a web path and having dispensing apertures for air or other fluid and feed openings arranged with respect to the apertures to direct the air perpendicularly toward the web path. Disclosed also are housings having duct means for returning the air dispensed by the housing to an air circulation system.

8 Claims, 7 Drawing Figures

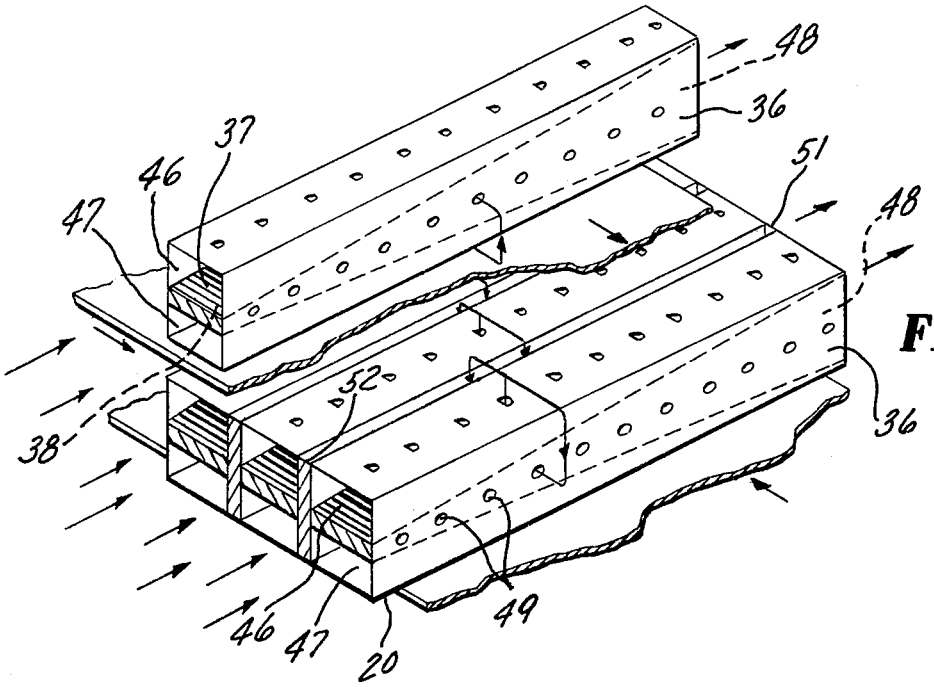
FIG.4
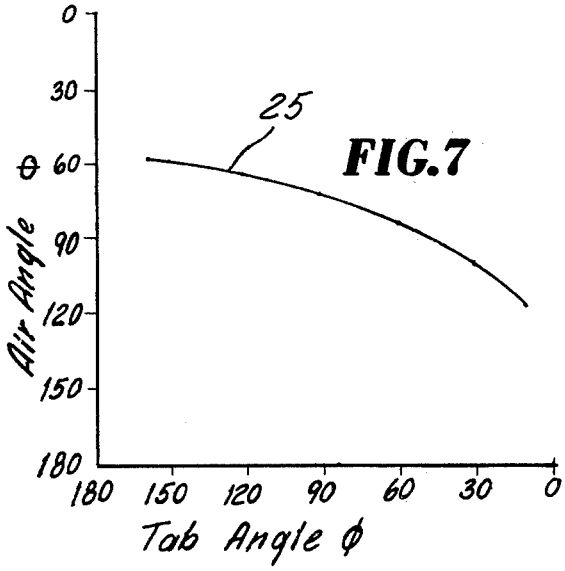
FIG.7
FIG.5
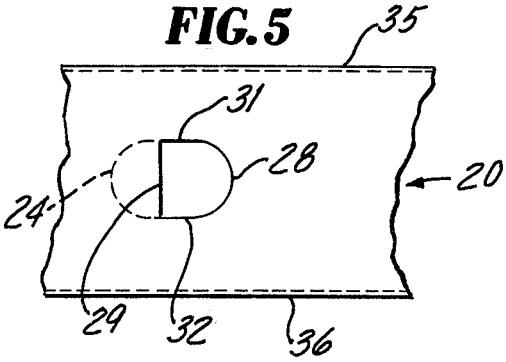
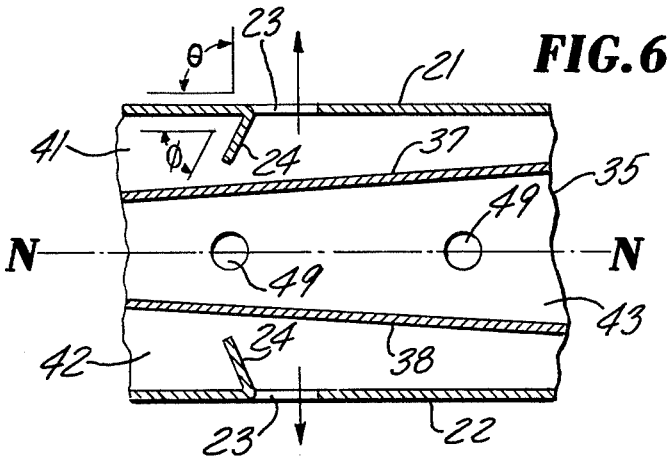
FIG.6

AIR CIRCULATING APPARATUS FOR FLOATING MATERIAL IN WEB FORM

BACKGROUND OF THE INVENTION

The invention is useful, for example, in the floater air dryer section of a machine for processing wood fiber pulp. In a typical pulp machine, the pulp web passes through a series of mechanical presses and/or dryers and then through in a floater air dryer section. The web is floated between a series of decks of nozzle boxes out of which hot air is ejected for the dual purpose of supporting and drying the web. In the normal arrangement of this section of a pulp machine, a series of horizontal nozzle or blow boxes form a deck to which hot air is supplied through ends of the boxes near one side of the web path. Air is ejected vertically from the individual nozzle boxes from opposite directions toward the web path to both float and dry the web as it passes through a series of vertically arranged horizontal passes of the dryer. The stability of web-floating, rate of heat transfer, and evaporation rate depend upon the manner of impingement of the air on the web.

In at least one type of operation, it is recognized as desirable to direct the air from the nozzle boxes in a direction at right angles with the web path. Current designs either do not achieve the perpendicular air flow, or they make use of turning vanes, straighteners, or perforated sheets placed beneath the exit air apertures in the nozzle boxes to obtain the desired mode of impingement. Any such constructions require the use of material for the "straighteners" and the expense of fan horse power to overcome the pressure loss against the apertures resulting from straightening the air.

Attempts were made through testing on full scale dryer equipment having nozzle boxes which did not include auxiliary structure, such as straighteners, turning vanes, perforated sheets etc. Floating motion and floating instability of the web was encountered which was eventually determined to be caused by the non-vertical or non-perpendicular direction relative to the web path of the exit path of the air from the apertures in the nozzle boxes. Many variations of apertures were tested until a satisfactory design was found.

Objects of such experimentation were to find a nozzle box design capable of discharging jets of air in the desired direction which was simple in design and economical to construct but could be operated efficiently from an energy standpoint without undesirable behavior of the web. A nozzle box design was discovered which is arranged as herein disclosed to provide an aperture and air-deflecting tab design which has proved to be highly efficient and to cause virtually no pressure loss at dryer design operating levels. A substantial further benefit of this design is its ease of manufacture.

SUMMARY OF THE INVENTION

This invention resides essentially in a nozzle box, referred to also by the trade as a "blow box" having a certain configuration of apertures and internal air-deflecting tabs, and also in a combination of such boxes within an air circulation system. The individual nozzle box is elongate and encloses a fluid-dispensing chamber extending lengthwise of the box from which air and other fluid is discharged through a planate wall of the box provided with exit apertures for the fluid spaced lengthwise of the box. The chamber has an inlet opening at its upstream end through which fluid may be directed lengthwise of the box toward its other closed end. The apertures of the planate wall is spaced the lengthwise direction of the chamber. The box further comprises tabs extending inwardly of the chamber from the upstream edge of each aperture. In a preferred arrangement each aperture is concavely curvate along its downstream edge and transversely rectilinear along its upstream edge. It a preferred design, peripheries of the tab and the aperture are complementary. To achieve issuing of a fluid from the fluid-dispensing chamber in direction perpendicular to the planate wall, the tab adjacent to each aperture stands at an angle approximately 45° with the portion of the wall immediately upstream from the upstream edge of the aperture.

The nozzle box in a preferred form comprises two air-dispensing chambers and an air-exhausting compartment separating the two chambers. The chambers are adjacent to oppositely facing parallel planate walls at opposite sides of the nozzle box and provided with tabs and apertures as described above. The compartment is separated from the dispensing chambers by a pair of interior divider walls joining with the upstream end of the housing at an intermediate plane between and parallel to the planate walls. The divider walls extend from the upstream end to the downstream end of the box in diverging relation with each other and converging relation with the nearer respective planate walls. Thus, the dispensing chambers are converging or decreasing in cross section toward the downstream end of the box whereas the compartment diverges toward the downstream end of the box which provides an exhaust opening for the compartment. The box is provided with apertures through the side walls of the compartment to allow fluid which escapes from the apertures of the chamber to reenter the box, i.e., into the compartment, and escape therefrom at the exhaust opening of the compartment.

Such a box construction as just described gives rise to another feature of the invention occurring in an assembly of such boxes arranged in a deck positioned between two parallel passes of a dryer wherein the longitudinal side surfaces of the nozzle boxes face into a region enclosed by spaced wall means penetrated by the opposite ends of the boxes to create a central region surrounding the boxes and the web paths walled off from plenums at either side of the central region in communication with the end openings. The effect of such enclosure is to be able to feed any air by a plenum adjacent inlet openings of the dispensing chambers, exhaust the air through the apertures thereof into the web circulating region, and then force the air back into the apertures of the exhaust compartment and out of the exhaust opening thereof into an air collecting plenum.

BRIEF DESCRIPTION OF THE DRAWING

The invention is described below with reference to the drawing in which:

FIG. 4 is a fragmentary perspective view of an enlargement of elements of the apparatus shown in FIG. 3.

FIG. 5 is a fragmentary plan view of a section of a nozzle box having an aperture.

FIG. 6 is a fragmentary side elevation in cross section of the nozzle box section shown in FIG. 5.

FIG. 7 is a graph providing a curve illustrating the relationship of angles Phi and Theta of FIG. 6. Angle Theta measures as an abscissa value the angle of air departure from the nozzle box with respect to the plane of the adjacent aperture. Angle Phi measures as an ordinate value the angle of the tab with respect to the plane of the aperture or adjacent wall.

DESCRIPTION OF THE PREFFERED EMBODIMENT

Figure 1:
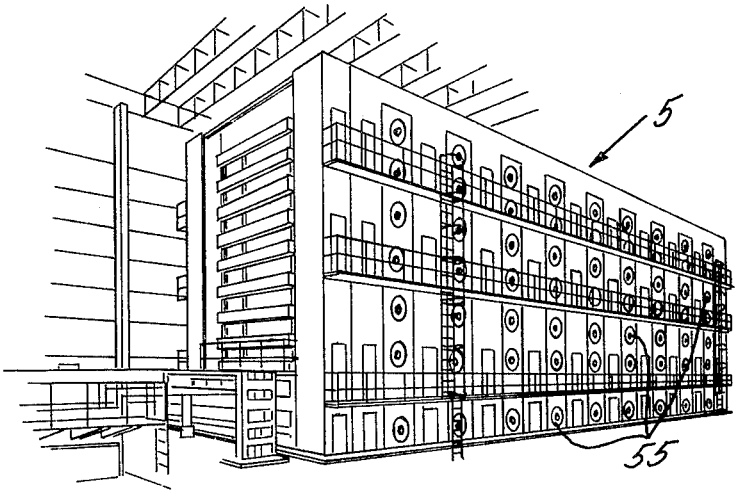
FIG. 1 is an exterior perspective view of an air floater pulp dryer in which apparatus according to this invention may be incorporated.
Figure 2:
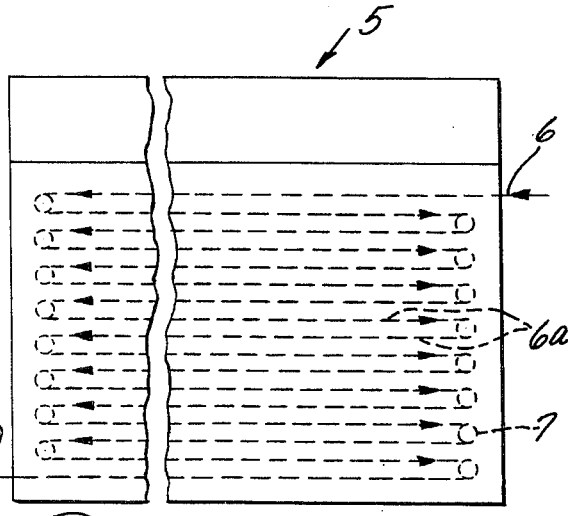
FIG. 2 is a schematic view illustrating the general arrangement of the web path within the dryer of FIG. 1.
Figure 3:
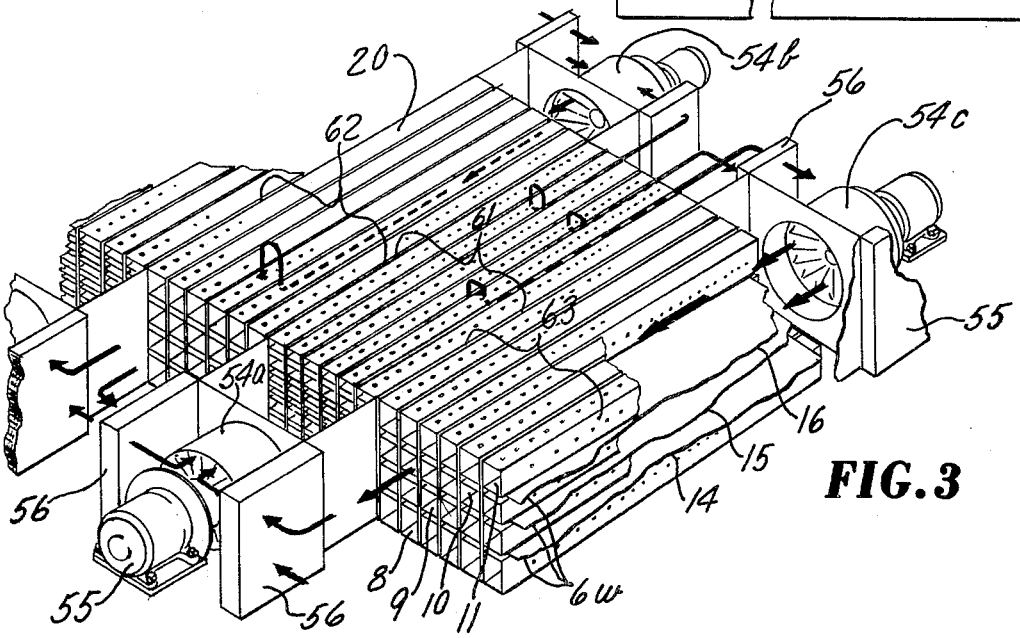
FIG. 3 is a fragmentary perspective view of an internal portion of the pulp dryer illustrated in FIG. 1 illustrating portions of several decks of nozzle boxes in relation to a plurality of horizontal passes of the web path with arrows superimposed to indicate generally the path of air circulation through the nozzle boxes.

FIG. 1 illustrates by way of example, the housing of a large multiple deck pulp dryer 5 in which nozzle boxes according to this invention are arranged in horizontally extending decks mounted between each pair of adjacent passes 6*a* of a web path 6 generally arranged as shown in FIG. 2. As shown, the passes 6*a* of the web path are horizontal and parallel with the web traveling in opposite direction in adjacent passes as the web reverses direction in passing around rolls 7. As FIGS. 3 and 4 illustrate, nozzle boxes 20 are arranged in a vertical series of decks, e.g., decks 8, 9, 10 and 11 between which extends passes 14, 15, 16 of the web 6w. In each deck, the individual nozzle boxes are spaced from each other by gaps aggregating, e.g., 2 to 3 percent of the plan area of the deck facing the web path. Nozzle boxes of a deck that are positioned between two passes of the web are designed to discharge air toward both passes. Obviously, the extreme upper deck and lower deck will be facing only one path of the web and thus are designed to discharge air from one side of the deck only.

The great majority of the nozzle boxes of a dryer are positioned between passes and are thus of the design shown in FIG. 4 wherein each box 20 is of generally rectangular outer configuration in three mutually perpendicular planes as shown in FIG. 4 and especially in FIG. 6. Each box 20 comprises a pair of elongate parallel planate walls 21,22 constituting opposite sides of the box 20 and normally facing adjacent passes of the web. The walls 21,22 each have apertures 23 uniformly spaced in the lengthwise direction of the box, i.e., the cross wise direction of the web path.

As FIGS. 5 and 6 show, a tab 24 is supported by its respective planate wall 21 or 22 along the inner side of the wall at the upstream edge of each aperture 23. The tab extends inwardly from the plane of its respective wall at an angle selected in accordance with a desired direction in which air is to be discharged from the nozzle box. The appropriate angle for setting the tabs may be selected in accordance with the curve 25 of FIG. 7 wherein the abscissa is measured by angle Phi, the angle the tab 24 makes with the plane of the portion of the planate wall immediately upstream from the adjacent aperture, and the ordinate is measured by angle Theta, the angle the direction of air departure from the aperture 23 makes with the portion of the planate wall immediately upstream from the aperture. Ordinarily, the aperture 23 and the tab 24 are made by punching the sheet metal for forming the walls 21 and 22 and bending the tab out of the aperture 23 to the correct or desired angle. As illustrated in FIG. 5, both the aperture and the tab having mating peripheries which conform to the concavely curvate or semi-circular downstream portion 28 of the aperture 23, and a transversely rectilinear portion 29 at the upstream edge of the aperture. As shown, the periphery of the aperture also consists of straight lateral portions 31,32 which connect portions 28,29. The tab 24 as is shown has corresponding portions of its peripheries and is normally of flat shape as a result of typical stamping or punching of flat sheet metal.

FIGS. 5 and 6 indicate that the box 20 has side walls 35,36 to which are attached internal divider walls 37,38 which divide the internal region of the box into separated air-dispensing chambers 41,42 and an air exhausting compartment 43. As FIG. 4 shows, the divider walls join within the upstream end of the housing at an intermediate plane N-N to define inlet openings 46,47 for chambers 41,42, respectively. The divider walls 37,38 extend in the longitudinal direction of the box diagonally therethrough from the inlet end of the box in diverging relation with each other and the plane N-N, and in converging relation with respective adjacent planate walls 21,22 to terminate in an exhaust opening 48 of the compartment 43 at the exhaust end of the box. Apertures 49 opening into compartment 43 are provided in one or both side walls of the box to enable air discharged from the apertures 23 to reenter the box into the compartment 43 and be discharged from the box through the opening 48. Because of the diverging relationship of the divider walls 37,38, the chambers and the compartment are triangular in vertical longitudinal cross section by which the chambers 41,42 increase and the chamber 43 decrease in transverse cross section in a direction proceeding from the inlet end to the exhaust end of the box 20.

The spacing of the boxes 20 in the longitudinal direction of the web produces a pressure drop in air passing from a web-treating region between the deck face and the air-suspended web into the spaces between the boxes. Such spacing may be varied at both sides of a web pass in relation to various other factors which contribute to a static pressure cushion which cooperates with the dynamic pressure of the jet streams issuing from decks of boxes 20 at both sides of the web to maintain the desired position and smooth travel of the web between opposing decks. Important factors are, e.g., the weight of the web, supply air pressure, and air jet velocity.

Referring back to FIG. 3, air is forced into a web-treating region surrounding the boxes and the web path enclosed by bulkhead walls 51,52 at opposite ends of the boxes. The walls 51,52 may comprise a multitude of small elements capable of being pressed at the end edges of the boxes to bridge the spaces therebetween. The bulkhead walls partition plenum regions contiguous with the end openings of the boxes from the web treating region, the between-box spaces containing their intervening lengths. The boxes thus open into plenum regions at opposite sides of the decks thereof. For example, fans 54 driven by motors 55 are positioned within plenum regions separated by the bulkhead walls 51,52 from the web-treating region. The fans 54 force air into the inlet openings of the air dispensing chambers 41,42 of the boxes and outwardly of the apertures 23 into space adjacent to the traveling web. The fans 54 tend to develop negative pressure within respective plenums to draw air through air filters 56 from adjacent plenums as indicated by the arrows in FIG. 3. In this manner, air is relayed from fan to fan. It should be noted within a single deck of boxes that in one section of the deck that the inlet and exhaust openings are reversed with respect to the adjacent section of the deck and that fans 54 are staggered along the opposite sides of the dryers to enable fans at one side of the dryer to pull on air being pushed through the dryer in a transverse direction by fans at the other side of the dryer. For example, air is being pushed toward the left by fans 54*a* through a deck section 61. Such air ultimately passes into the intake of fans 54*b*,54*c* pumping air into the adjacent deck sections 62,63, respectively. In this manner, air is recirculated toward a saturated condition under which it is removed near the top of the entire dryer apparatus as shown in FIG. 1. The total body of air within dryer 5 may, e.g., be replenished along the entire length of the lower part of the dryer from which air moves very gradually up through the height of the dryer while being laterally circulated many times by the fans 54*a*,54*b*, etc. until it arrives in top plenum chambers of the dryer and is discharged therefrom.

Essential to the invention as disclosed above is construction of the individual boxes 20 resulting in direction air toward a web path in the direction desired. While the graph in FIG. 7 indicates much choice in determining the direction of air relative to the plane of the web, dryer operation as currently desired involves discharging air from the boxes in a direction perpendicular to the web path. In general, the boxes 20 are constructed with apertured airdischarging walls in parallel relation with the web path. As the curve 25 of FIG. 7 will indicate, a Phi angle (tab angle) of 45° results in an angle Theta (air angle) of approximately 90° . Hence, when walls 21,22 are planate and parallel with the web path and angle Phi of 45° is the most desired under present practice.

What is claimed is:

1. A fluid ejecting nozzle box for effecting fluid suspension of a web comprising:

an elongate housing defining a correspondingly elongate fluid-dispensing chamber of gradually decreasing cross section in its downstream elongate direction and having a feed opening at the upstream end of the chamber through which fluid can be injected as a stream aligned in the lengthwise downstream direction of the chamber; said housing having a planate wall extending the length of, and partially defining, said chamber, said wall having an inner surface facing inside the chamber and a plurality of apertures spaced in said direction;

a like plurality of fluid-deflecting tabs, each tab supported by said wall along said inner side at the upstream edge of each aperture with its flat areas in transverse relation with said direction and extending inwardly of the chamber to lean upstream from said edge at an angle of approximately 45 degrees with respect to a portion of said wall extending upstream from said aperture to vary the direction of fluid passage from the respective adjacent aperture to an angle of approximately 90 degrees, respectively, with respect to said upstream wall portion.

2. The nozzle box of claim 1 wherein:

said aperture is concavely curvate along its downstream edge and transversely rectilinear along its upstream edge and the peripheries of said tab and said aperture are complementary.

3. The nozzle box of claim 1 wherein:

said tabs extend at an angle of approximately 45 degrees with respect to a portion of said wall upstream from said aperture.

4. The nozzle box of claim 1 wherein:

said wall and tabs are integral and formed from a sheet material of which material displaced from said apertures extends at an angle with said wall to form said tabs.

5. The nozzle box of claim 1 comprising:

an interior divider wall extending lengthwise within said housing to divide the interior thereof to said chamber and a compartment;

said housing having side walls of which at least one side wall provides apertures into said compartment, said housing having an exhaust opening at the end of the housing opposite the end thereof providing said feed opening.

6. The nozzle box of claim 5 wherein:

said housing has a uniform transverse cross section, and said divider wall is opposite said planate wall within said chamber and extends diagonally within said housing to form said chamber and said compartment in configurations of decreasing cross section which taper from respective end openings.

7. The nozzle box of claim 1 wherein said housing is constructed of uniform transverse rectangular cross section and comprises:

a second planate wall forming with said first named planate wall opposite sides of said housing, said second planate wall having apertures and tabs attached thereto as arranged in said first planate wall;

a pair of interior divider walls joining within the upstream end of the housing at an intermediate plane between, and parallel to, said planate walls and extending diagonally therefrom through said housing in diverging relation with each other and converging relation with the nearer of said planate walls, said divider wall each connecting with one of said planate walls at the downstream end of the housing to enclose said first chamber, a second fluid-dispensing chamber, and a compartment therebetween having an exhaust opening for said compartment in said downstream end of the housing;

said housing having side walls with apertures opening into said compartment whereby a fluid discharged from said chamber apertures may enter said compartment and be discharged from the compartment through said exhaust opening.

8. In web treating apparatus wherein a web path comprises a series of advance and return parallel passes, each pair of adjacent passes having a space therebetween;

means at the ends of the passes for supporting, propelling, and guiding the web from one pass to the next downstream pass;

fluid-dispensing apparatus comprising a plurality of elongate housings fixedly positioned within the space between a pair of adjacent passes in uniformly spaced relation with both passes;

said housings extending longitudinally in the transverse direction of the web path and being spaced uniformly in the longitudinal direction of the web path;

each housing being constructed of uniform transverse rectangular cross section and comprising a pair of planate walls forming opposite sides of said housing facing said passes, each planate wall having a plurality of apertures spaced in its lengthwise direction or the transverse direction of said path;

a like plurality of fluid-deflecting tabs supported by each wall along its inner side at the upstream edge of each aperture to extend inwardly of the housing and lean upstream from said edge at an angle which varies to a greater or lesser angle of approximately 45 degrees with respect to a portion of the respective wall extending upstream from said aperture to vary the direction of fluid passage from the respective adjacent aperture to an angle lesser or greater than approximately 90°, respectively, with respect to said upstream wall portions;

a pair of divider walls joining with the upstream end of the housing at an intermediate plane between, and parallel to, said planate walls and extending diagonally therefrom through said housing in diverging relation with each other and converging relation with the nearer of said planate walls, said divider walls each connecting with one of said planate walls at the downstream end of the housing to enclose said first chamber, a second fluid-dispensing chamber, and a compartment therebetween having an exhaust opening for said compartment in said downstream end of the housing;

each housing having side walls with apertures opening into said compartment;

wall means surrounding said housings as a group except for end openings of said housings to provide an enclosed plenum space surrounding the sides of the housing which said web path extends between pluralities of said housings;

means for pumping a fluid into the upstream openings of said housing, said wall means acting to force air discharged from said chamber apertures into said compartment apertures and outwardly of the housings and said downstream openings thereof.

* * * * *